US008720397B2

(12) United States Patent
Glogowski

(10) Patent No.: US 8,720,397 B2
(45) Date of Patent: May 13, 2014

(54) COMPENSATING ARRANGEMENT FOR A VARIABLE COMPRESSION RATIO ENGINE

(76) Inventor: Michal Glogowski, Lodz (PL)

( * ) Notice: Subject to any disclaimer, the term of this patent is extended or adjusted under 35 U.S.C. 154(b) by 258 days.

(21) Appl. No.: 13/391,818

(22) PCT Filed: Aug. 25, 2010

(86) PCT No.: PCT/EP2010/062402
§ 371 (c)(1),
(2), (4) Date: Feb. 23, 2012

(87) PCT Pub. No.: WO2011/023725
PCT Pub. Date: Mar. 3, 2011

(65) Prior Publication Data

US 2012/0145129 A1 Jun. 14, 2012

(30) Foreign Application Priority Data

Aug. 25, 2009 (PL) ..... 388876

(51) Int. Cl.
*F02B 75/04* (2006.01)

(52) U.S. Cl.
USPC ..... 123/78 D; 123/48 D

(58) Field of Classification Search
CPC ..... F02D 15/04; F01L 5/045; F02B 75/28; F02B 75/04; F02B 75/042
USPC ..... 123/48 A, 48 R, 48 C, 48 D, 78 R, 78 C, 123/78 D, 48 AA, 78 A
See application file for complete search history.

(56) References Cited

U.S. PATENT DOCUMENTS

| | | | | | |
|---|---|---|---|---|---|
| 752,936 | A | | 2/1904 | Vogt | |
| 2,419,450 | A | | 4/1947 | Howard | |
| 2,420,117 | A | * | 5/1947 | Weatherup | 123/48 AA |
| 2,769,433 | A | * | 11/1956 | Humphreys | 123/48 AA |
| 2,914,047 | A | * | 11/1959 | Colton | 123/48 AA |
| 4,202,300 | A | * | 5/1980 | Skay | 123/432 |
| 4,516,537 | A | * | 5/1985 | Nakahara et al. | 123/48 AA |
| 5,476,072 | A | | 12/1995 | Guy | |
| 6,708,655 | B2 | | 3/2004 | Maloney et al. | |

FOREIGN PATENT DOCUMENTS

| | | | | | |
|---|---|---|---|---|---|
| DE | 3117133 | A1 | * | 11/1982 | F02D 15/04 |
| GB | 27740 | | | 0/1909 | |
| JP | 58197438 | A | * | 11/1983 | F02D 15/04 |

* cited by examiner

*Primary Examiner* — Hung Q Nguyen
(74) *Attorney, Agent, or Firm* — Mark M. Friedman

(57) ABSTRACT

A compensating arrangement for a variable compression ratio engine, the compensating arrangement comprising a piston (1) reciprocally movable in a guiding sleeve (2) having an open end (24) in communication with a combustion cylinder of the engine and a closed end (11, 30), wherein the arrangement further comprises a first pneumatic cushion (20) formed between the closed end (11, 30) of the guiding sleeve (2) and the internal surface of the piston (1) such as to limit the movement of the piston (1) towards the closed end (11, 30) of the guiding sleeve (2), a second pneumatic cushion (19) formed between the guiding sleeve (2) and the external surface of the piston (1) such as to limit the movement of the piston (1) towards the open end (24) of the guiding sleeve (2), and a check valve (18) configured to provide pneumatic medium to the second pneumatic cushion (19) in amount dependent on the displacement of the piston (1) during its movement towards the closed end (11, 30) of the guiding sleeve (2).

20 Claims, 6 Drawing Sheets

COMPENSATING ARRANGEMENT FOR A VARIABLE COMPRESSION RATIO ENGINE

TECHNICAL FIELD

The present invention relates to arrangements used in variable compression ratio engines.

BACKGROUND ART

Variable compression ratio engines allow achieving high compression ratios, typically by means of an additional adjustable piston opposing the primary piston.

An example of such configuration is shown in a U.S. Pat. No. 6,708,655, which describes an internal combustion engine, comprising a combustion cylinder, a cylinder head at an end of the combustion cylinder and a primary piston reciprocally disposed within the combustion cylinder. The cylinder head includes a secondary cylinder and a secondary piston reciprocally disposed within the secondary cylinder. An actuator is coupled with the secondary piston for controlling the position of the secondary piston dependent upon the position of the primary piston, and a communication port establishes fluid flow communication between the combustion cylinder and the secondary cylinder. The actuator can be hydraulic or a cam actuator. The construction of the device is relatively complex.

The aim of the present invention is to provide a compensating arrangement for a variable compression ratio engine which has a simple construction and high efficiency.

DISCLOSURE OF INVENTION

The object of the invention is a compensating arrangement for a variable compression ratio engine, the compensating arrangement comprising a piston reciprocally movable in a guiding sleeve having an open end in communication with a combustion cylinder of the engine and a closed end, wherein the piston has a shape of a hollow cylindrical tube having a first portion with a closed end movable in a first portion of the guiding sleeve and a second portion having a diameter larger than the diameter of the first portion and an open end and movable in a second portion of the guiding sleeve, wherein the arrangement further comprises a first sealing between the first portion of the piston and the first portion of the guiding sleeve, a second sealing between the second portion of the piston and the second portion of the guiding sleeve, a first pneumatic cushion formed between the closed end of the guiding sleeve and the internal surface of the piston such as to limit the movement of the piston towards the closed end of the guiding sleeve, a second pneumatic cushion formed between the guiding sleeve and the external surface of the piston limited by the first sealing and the second sealing such as to limit the movement of the piston towards the open end of the guiding sleeve, a check valve configured to provide pneumatic medium to the second pneumatic cushion in amount dependent on the displacement of the piston during its movement towards the closed end of the guiding sleeve.

The piston may further comprise an intermediate portion, having a conically expanding shape and located between the first portion and the second portion of the piston.

The guiding sleeve may further comprise a buffer having a shape corresponding substantially to the internal profile of the intermediate portion of the piston configured to limit the movement of the piston towards the closed end of the guiding sleeve.

The guiding sleeve may further comprise a buffer having a shape corresponding substantially to the external profile of the intermediate portion of the piston configured to limit the movement of the piston towards the open end of the guiding sleeve.

The arrangement may further comprise an outlet conduit formed within the guiding sleeve in communication with the second pneumatic cushion to allow purge of pneumatic medium during movement of the piston towards the open end of the guiding sleeve.

The active cross-section of the outlet conduit can be adjustable by a needle valve.

The external wall of the first portion of the piston may comprise a recess and the first portion of the guiding sleeve comprises conduits, the recess and the conduits configured to be in fluid communication during movement of the piston.

The closed end of the guiding sleeve can be stationary.

The closed end of the guiding sleeve can be formed by a movable partition.

The movable partition may comprise an inlet conduit with a check valve for providing pneumatic medium to the first pneumatic cushion.

BRIEF DESCRIPTION OF DRAWINGS

The object of the invention is shown in exemplary embodiments on a drawing, in which.

MODES FOR CARRYING OUT THE INVENTION

Example 1

Best Mode for Carrying Out the Invention

Figure 1:
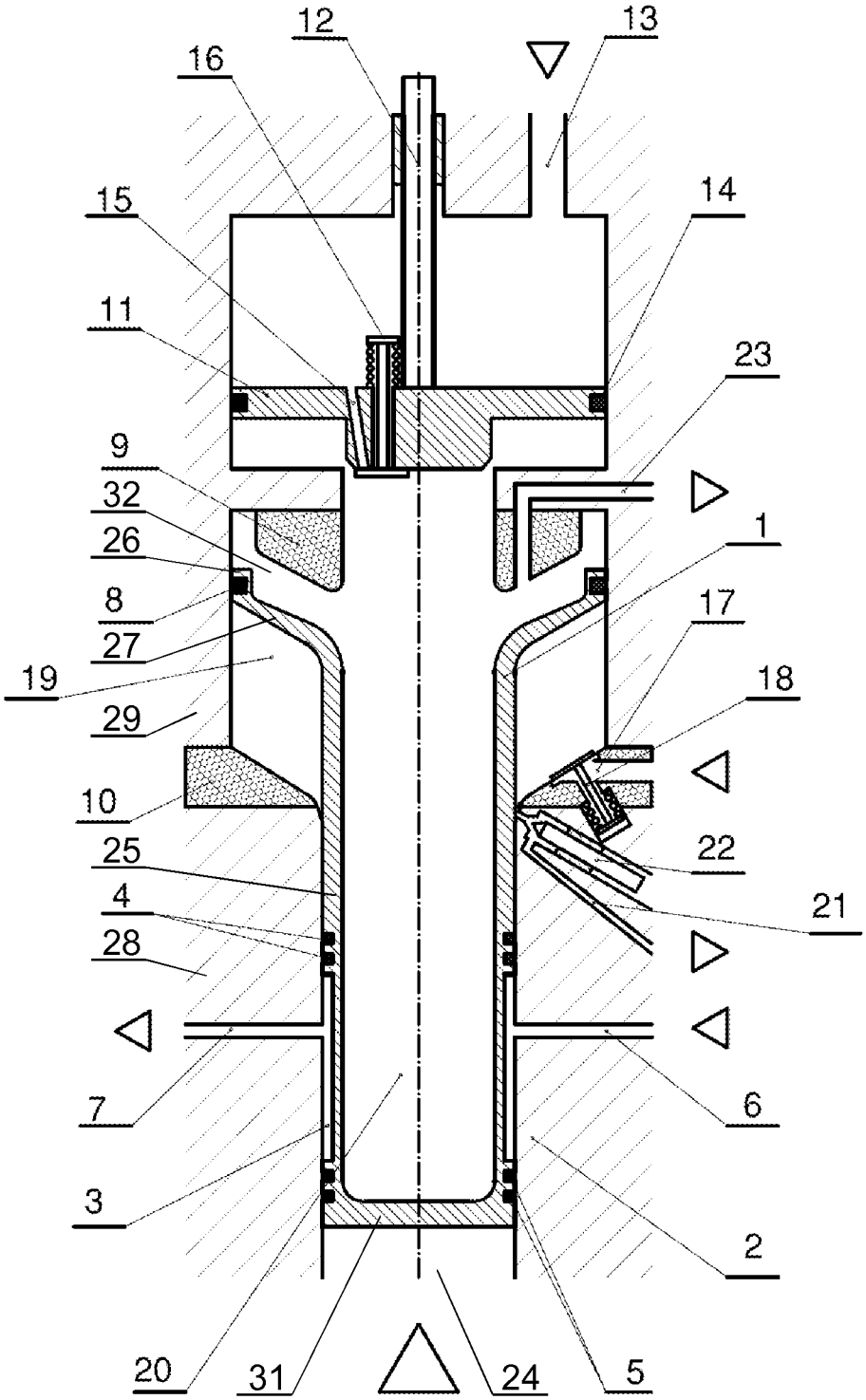
FIG. 1 shows the construction of the first embodiment of the compensating arrangement.

FIG. 1 shows the construction of the first embodiment of the compensating arrangement according to the invention, with a passive cushion having variable amount of pneumatic medium, which can be adjusted to the rotational speed and load of the engine during its operation. It comprises a shaped piston 1 placed coaxially and movable reciprocally in a guiding sleeve 2 having an open end 24 in communication with a combustion cylinder in which a primary piston is reciprocally movable (not shown). The piston 1 has a shape of a hollow cylindrical tube with a bottom portion 25 having a closed end 31 at the open end 24 of the guiding sleeve 2 and with a top portion 26 having a diameter larger than the diameter of the bottom portion 25 and an open end 32. An intermediate portion 27 having a conically extending shape joins the bottom portion 25 and the top portion 26 of the piston 1. The conical shape of the intermediate portion 27 is best suited to pistons 1 made of lightweight metals, such as magnesium or aluminum alloys. In case of pistons 1 made of composite materials, the shape of the intermediate portion 27 can be configured depending on the properties of the composite material used. The guiding sleeve 2 has a bottom portion 28 having a diameter corresponding to the bottom portion 25 of the piston and a top portion 29 having a diameter corresponding to the top portion 26 of the piston. A recess 3 is formed in the external wall of the bottom portion 25 of piston 1, while a bottom sealing 5 and a top sealing 4 are located respectively below and above the recess between the external wall of the piston 1 and the guiding sleeve 2. An inlet conduit 6 and an outlet conduit 7 are formed in the guiding sleeve 2 to provide fluid communication with the recess 3. In one embodiment, a lubricating and cooling mixture can be transported via the conduits 6, 7 to intensely flow around the recess 3 of the piston 1 to lubricate and cool the piston 1. In another embodiment, a small portion of oil can be transported via the conduits 6, 7 to only lubricate the piston 1, while the piston is cooled by the bottom sealing 5 and cooling of the guiding sleeve 2. A top pneumatic sealing 8 is mounted to the piston 1 between the external perimeter of the top portion 26 and the guiding sleeve 2. The top portion 26 of the piston 1 moves in the top portion 29 of the guiding sleeve 2 between a top buffer 9 mounted to the guiding sleeve 2 and a bottom buffer 10 mounted to the guiding sleeve 2. The top buffer 9 further comprises an outlet conduit 23 for pneumatic medium. The external surface of the top buffer 9, which limits the movement of the piston 1 towards the closed end 11 of the guiding sleeve 2, corresponds substantially to the internal profile of the intermediate portion 27 of the piston 1 when the piston exerts pressure on the top buffer 9. The external surface of the bottom buffer 10, which limits the movement of the piston 1 towards the open end 24 of the guiding sleeve 2, corresponds substantially to the external profile of the intermediate portion 27 of the piston 1 when the piston exerts pressure on the bottom buffer 10. Preferably, the buffers deform elastically to the shape of the piston under pressure of the piston 1 on the buffers 9, 10. The buffers 9, 10 can be made of elastomers resistant to high temperatures.

The top portion 29 of the guiding sleeve 2 comprises, preferably above the top buffer 9, a movable partition 11 mounted on a guide 12 movable via an opening in the top wall of the guiding sleeve 2, in which an inlet conduit 13 for pneumatic medium is formed. The movable partition 11 has a sealing 14 mounted between its outer perimeter and the guiding sleeve 2. The movable partition 11 further comprises, in its middle part, an inlet conduit 15 for pneumatic medium, closed by a check valve 16, such as a flap valve or channel valve. The bottom buffer 10 comprises an inlet conduit 17 for pneumatic medium closed by a check valve 18, such as a flap valve or channel valve. Furthermore, an outlet conduit 21 for pneumatic medium and an adjustable needle valve 22 for adjusting the active cross-section of the outlet conduit 21 are placed in the bottom buffer 10 near the guiding sleeve.

Figure 2:
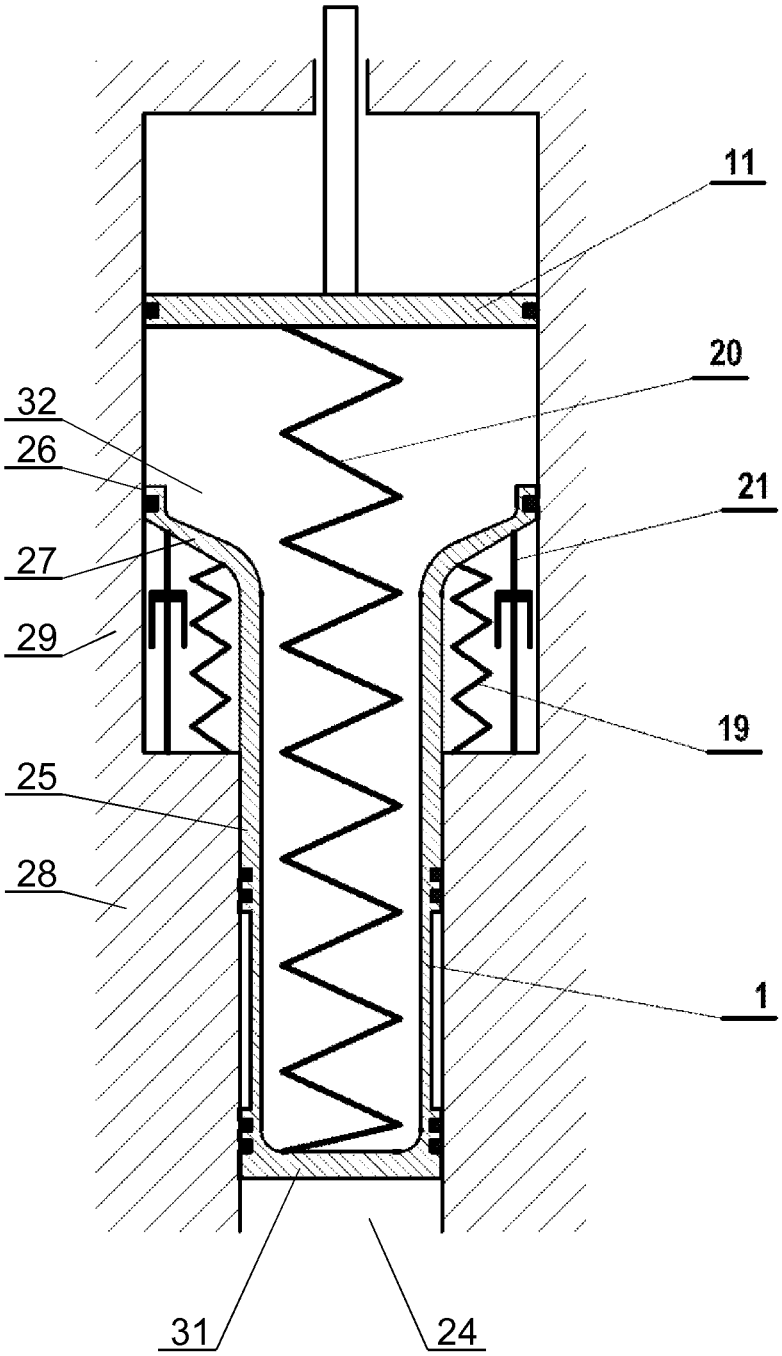
FIG. 2 shows schematically the support of the piston of the first embodiment of the compensating arrangement by pneumatic cushions.

FIG. 2 shows schematically the support of the piston of the first embodiment of the compensating arrangement by pneumatic cushions. During its operation, the piston 1 is reciprocally movable in the guiding sleeve 2, while its movement is resiliently limited by a passive pneumatic cushion 20 and an active pneumatic cushion 19. The pneumatic active cushion optimally slows down the piston during the process of internal recuperation and promotes its movement during the process of internal energy accumulation of the compensating arrangement according to the invention. The pneumatic active cushion 19 comprises pneumatic medium between the guiding sleeve and the external surface of the piston 1 below its top portion 26. The pneumatic active cushion 19 is sealed with the top pneumatic sealing 8 and the top sealing 4 of the piston 1. It is supplied with pneumatic medium having regulated or constant pressure, preferably via the inlet conduit 17 embedded in the guide 2 and closed by the check valve 18. The check valve 18 is configured to provide pneumatic medium to the active pneumatic cushion 19 in amount dependent on the displacement of the piston 1 during its movement towards the closed end 11 of the guiding sleeve 2. The active cushion 19 is deflated via leaks, the outlet conduit 21 of a constant or regulated cross-section, or via an adjustable valve in case of engines having low rotational speeds and automatically regulated. In addition, the bottom buffer 10 protects the piston 1 against damage in case of inadequate amount of pneumatic medium or lack thereof in the active cushion 19. The active cushion 19 acts both as a spring and as a damper. The pneumatic active cushion 19 limits the movement of the piston 1 towards the open end 24 of the guiding sleeve 2. The pneumatic passive cushion 20 comprises pneumatic medium closed between the internal part of the piston 1 and a closed end of the guiding sleeve 2, which in the embodiment of FIG. 1 is formed by the movable partition 11. The pneumatic cushion is sealed by a pneumatic sealing 8 of the top portion 26 of the piston and the sealing 14 of the movable partition 11. The top buffer 9 protects the piston 1 against damage in case of inadequate amount of pneumatic medium in the passive cushion 20. The passive cushion 20 is supplied with pneumatic medium of a constant pressure via the inlet conduit 15 through the check valve 16. In case of automatic regulation, a controllable valve can be used in place of the check valve 16 in order to allow inflating and deflating of the pneumatic passive cushion 20 with pneumatic medium of a regulated pressure. The passive cushion acts as a spring. The pneumatic passive cushion 20 limits the movement of the piston 1 towards the closed end 11 of the guiding sleeve. The mass and geometry of the piston 1 is configured with respect to the heat engine in which it operates. The inlet pneumatic medium pressure and volume of the passive cushion 20, the inlet pneumatic medium pressure of the active cushion 19 and the cross-section of the outlet conduit 21 are adjusted with respect to a given rotational speed and load of the heat engine during its operation.

Example 2

Figure 3:
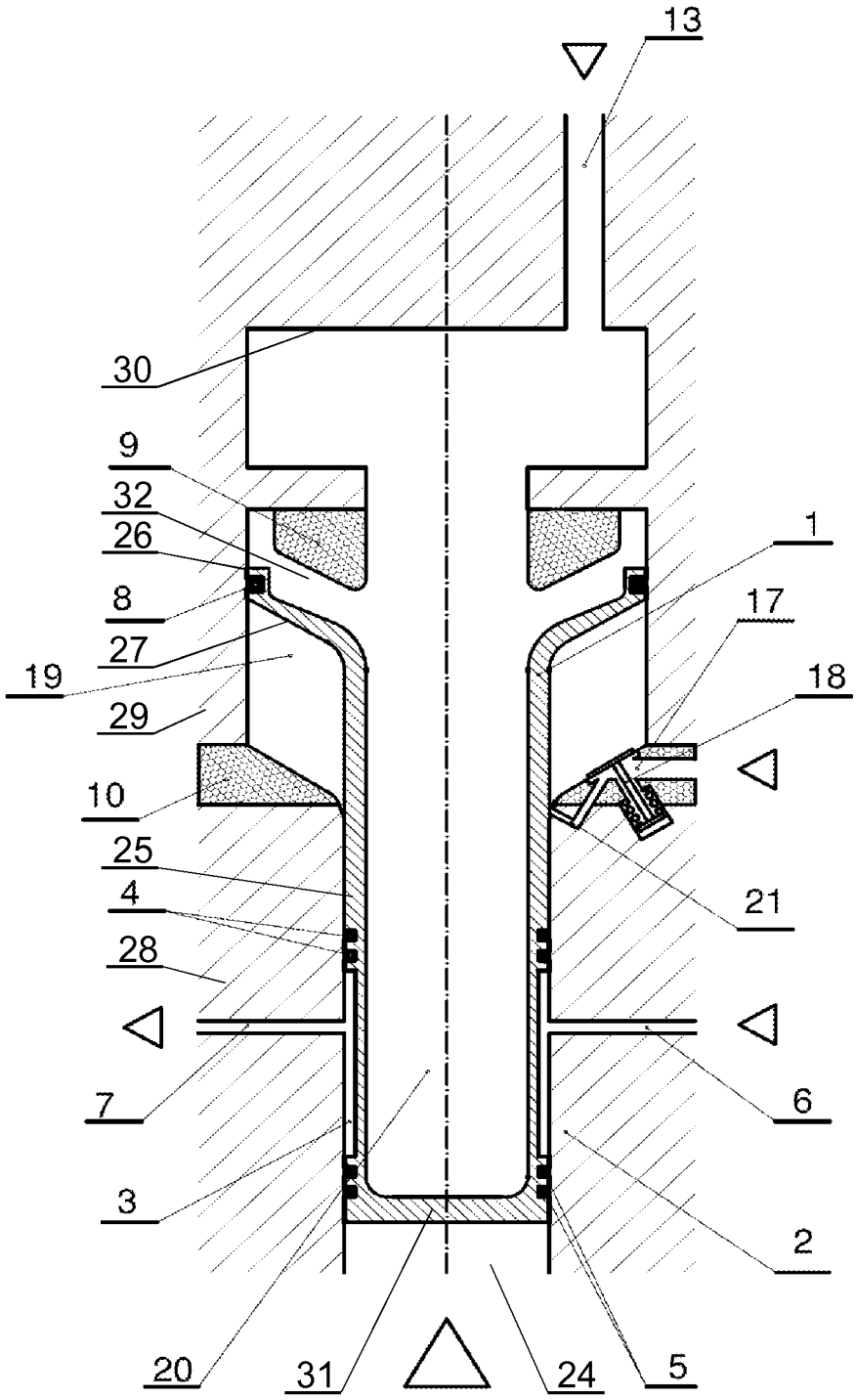
FIG. 3 shows the construction of the second embodiment of the compensating arrangement.

FIG. 3 shows the construction of the second embodiment of the compensating arrangement according to the invention, with a passive cushion having variable amount of pneumatic medium, usable in particular for engines of relatively constant load and rotational speed. The guiding sleeve 2 in this embodiment has a stationary closed end 30. Elements similar to the elements shown in FIG. 1 are referenced by the same numerals. It comprises a shaped piston 1 placed coaxially and movable reciprocally in a guiding sleeve 2 having an open end 24 in communication with a combustion cylinder in which a primary piston is reciprocally movable (not shown). The piston 1 has a shape of a hollow cylindrical tube with a bottom portion 25 having a closed end 31 at the open end 24 of the guiding sleeve 2 and with a top portion 26 having a diameter larger than the diameter of the bottom portion 25 and an open end 32. An intermediate portion 27 having a conically extending shape joins the bottom portion 25 and the top portion 26 of the piston 1. The conical shape of the intermediate portion 27 is best suited to pistons 1 made of lightweight metals, such as magnesium or aluminum alloys. In case of pistons 1 made of composite materials, the shape of the intermediate portion 27 can be configured depending on the properties of the composite material used. The guiding sleeve 2 has a bottom portion 28 having a diameter corresponding to the bottom portion 25 of the piston and a top portion 29 having a diameter corresponding to the top portion 26 of the piston. A recess 3 is formed in external wall of the bottom portion 25 of piston 1, while a bottom sealing 5 and a top sealing 4 are located respectively below and above the recess between the external wall of the piston 1 and the guiding sleeve 2. An inlet conduit 6 and an outlet conduit 7 are formed in the guiding sleeve 2 to provide fluid communication with the recess 3. In one embodiment, a lubricating and cooling mixture can be transported via the conduits 6, 7 to intensely flow around the recess 3 of the piston 1 to lubricate and cool the piston 1. In another embodiment, a small portion of oil can be transported via the conduits 6, 7 to only lubricate the piston 1, while the piston is cooled by the bottom sealing 5 and cooling of the guiding sleeve 2. A top pneumatic sealing 8 is mounted to the piston 1 between the external perimeter of the top portion 26 and the guiding sleeve 2. The top portion 26 of the piston 1 moves in the top portion 29 of the guiding sleeve 2 between a top buffer 9 mounted to the guiding sleeve 2 and a bottom buffer 10 mounted to the guiding sleeve 2. The top buffer 9 further comprises an outlet conduit 23 for pneumatic medium. The external surface of the top buffer 9 corresponds to the internal profile of the top portion 26 of the piston 1 when the piston exerts pressure on the top buffer 9. The external surface of the bottom buffer 10 corresponds to the external profile of the intermediate portion 27 of the piston 1 when the piston exerts pressure on the bottom buffer 10. Preferably, the buffers deform elastically to the shape of the piston under pressure of the piston 1 on the buffers 9, 10. The buffers 9, 10 can be made of elastomers resistant to high temperatures.

The top portion 29 of the guiding sleeve 2 comprises, preferably above the top buffer 9, an inlet conduit 13 for pneumatic medium. The bottom buffer 10 comprises an inlet conduit 17 for pneumatic medium closed by a check valve 18, such as a such as a flap valve or channel valve. Furthermore, an outlet conduit 21 for pneumatic medium and an adjustable needle valve 22 are formed in the bottom buffer 10 near the guiding sleeve.

Figure 4:
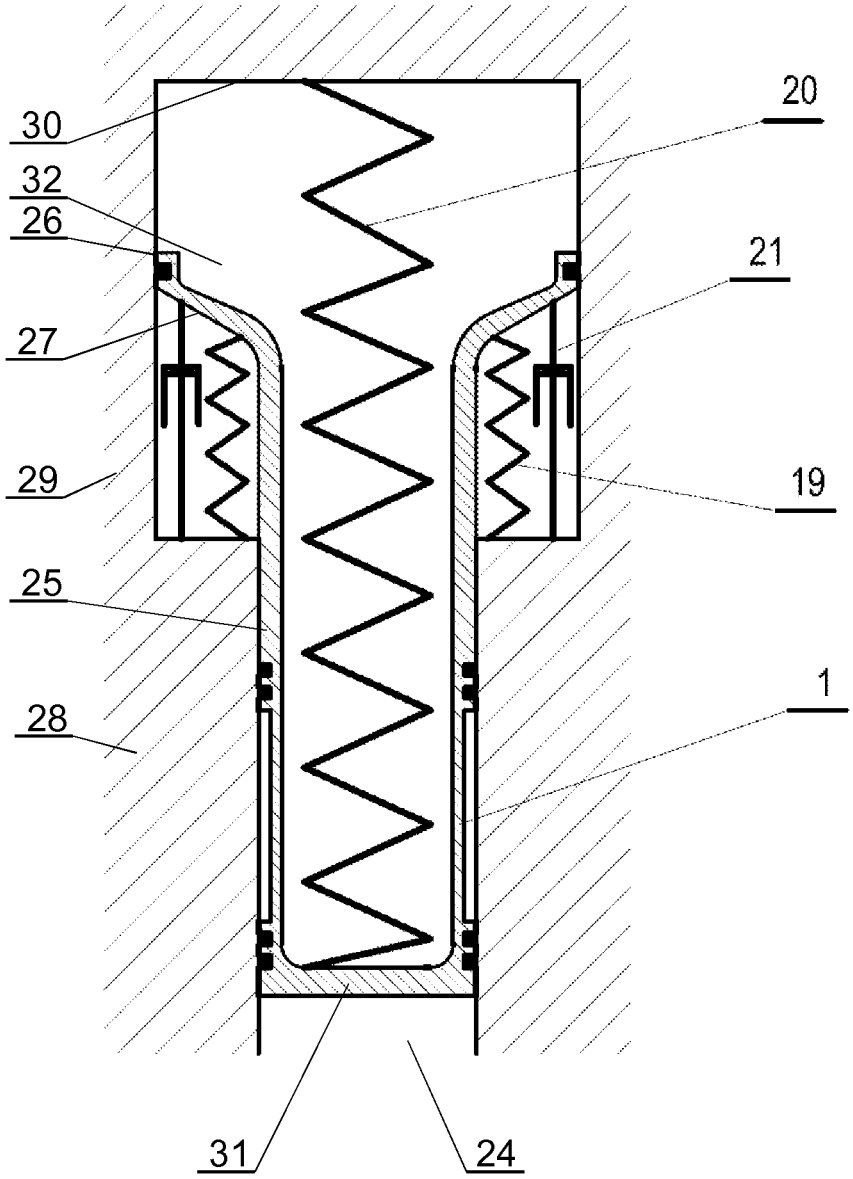
FIG. 4 shows schematically the support of the piston of the second embodiment of the compensating arrangement by pneumatic cushions.

FIG. 4 shows schematically the support of the piston of the second embodiment of the compensating arrangement by pneumatic cushions, which is analogous to the support of the piston of the first embodiment shown in FIG. 2, with the following difference. The maximum volume of the passive cushion 20 is constant, which makes the embodiment particularly suitable to engines operating with substantially constant rotational speed and substantially constant load.

The terms "top" and bottom" as used in the above description refer to position of particular elements on the drawing, but do are not intended to limit the placement of the compensating arrangement according to the invention in a vertical manner as shown in the drawings.

Figure 6:
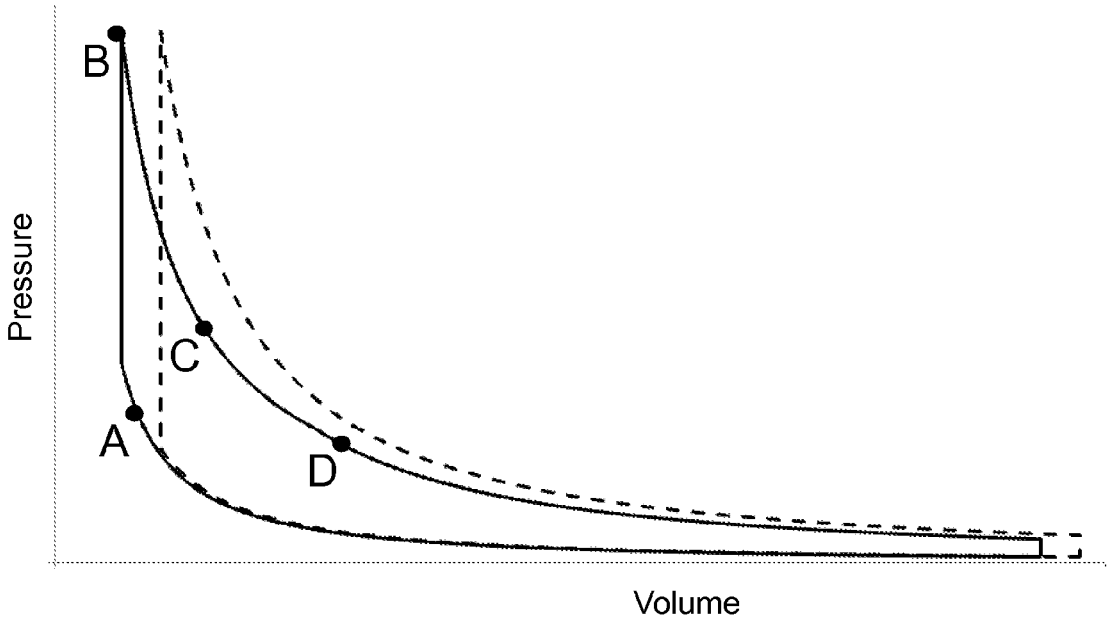
FIG. 6 shows schematically a comparison of a theoretical pressure-volume graph for a standard Otto cycle and the cycle of engine with compensating arrangement according to the invention.
Figure 7:
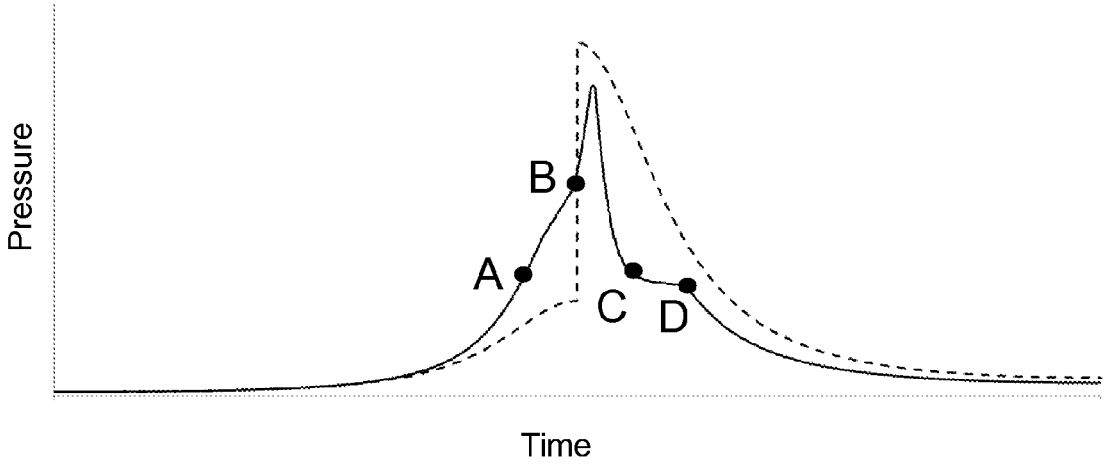
FIG. 7 shows schematically a comparison of variation of pressure in time for a standard engine and the engine with a compensating arrangement according to the invention.

FIGS. 5A-5D show the configuration of the compensating arrangement in different engine work phases, which will be described in relation to the graphs shown in FIGS. 6 and 7. FIG. 6 shows schematically a comparison of a theoretical pressure-volume graph for a standard Otto cycle (dashed line) and the cycle of engine with compensating arrangement according to the invention (continuous line). FIG. 7 shows schematically a comparison of variation of pressure in time for a standard engine (dashed engine) and the engine with a compensating arrangement according to the invention (solid line). References A-D on FIGS. 6, 7 correspond to piston positions shown in FIGS. 5A-5D.

Figures 5A, 5B, 5C, 5D:
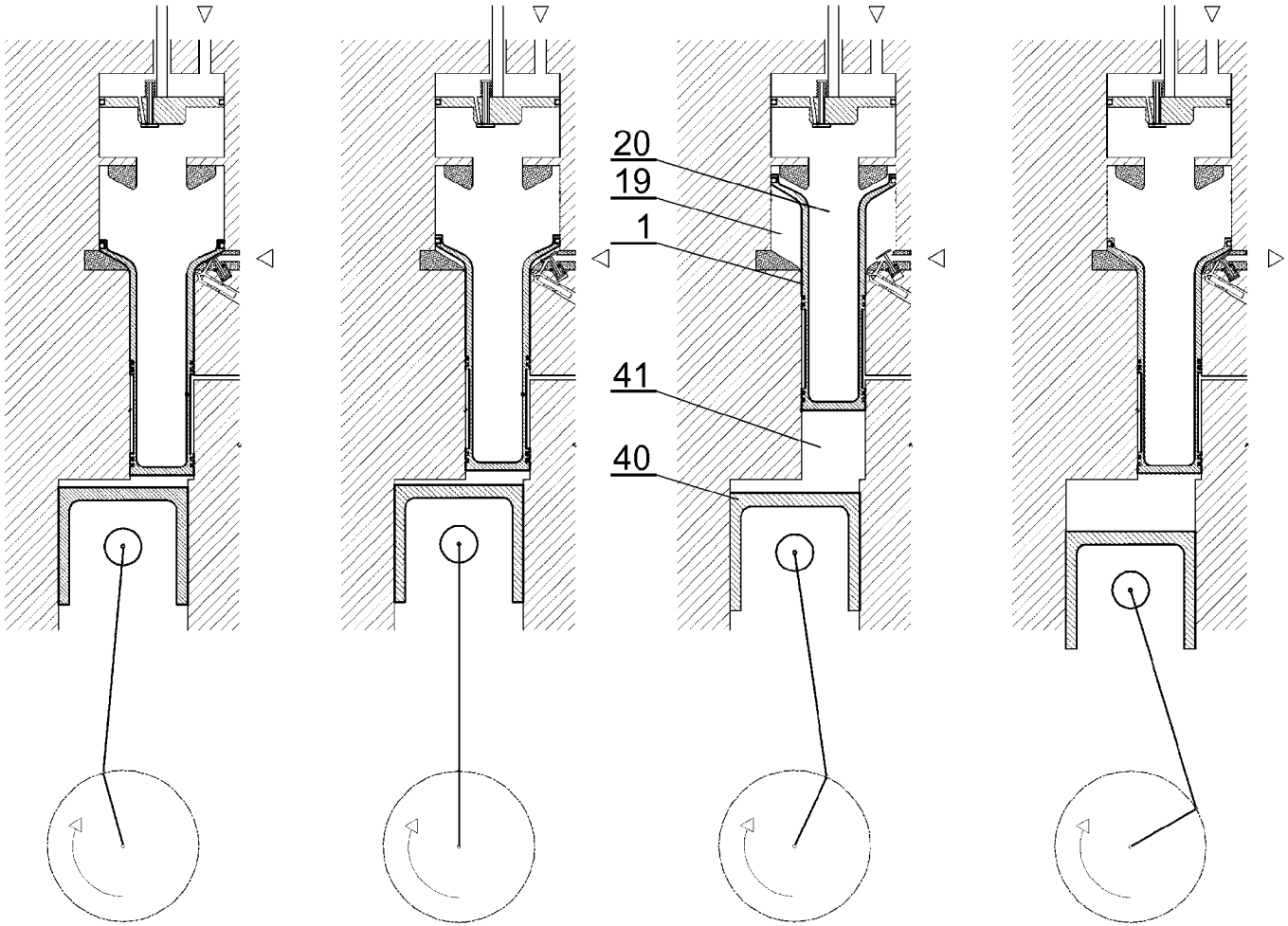
FIGS. 5A-5D show the configuration of the compensating arrangement during different engine work phases.

FIG. 5A corresponds to a phase in which the primary piston 40 reaches the top dead centre position and ignition is initiated. FIG. 5B corresponds to a phase in which the primary piston 40 is in the top dead centre. The increasing gas pressure causes rapid acceleration of the piston 1, which due to its mass smaller than the mass of the primary piston 40 moves faster than the primary piston 40. The piston 1 by moving upwards increases the volume of the combustion chamber 41, therefore compensating the increase of pressure. It reaches its maximum acceleration at the peak between points B and C shown in FIG. 7. At this peak the increase of volume of the combustion chamber 41 is so high that it causes decrease in pressure. When the pressure within the combustion chamber 41 drops below the pressure of the passive cushion 20 (taking into account the pneumatic ratio related to the difference between the top and bottom diameters of the piston 1), the piston 1 starts to decelerate and reaches its highest position shown in FIG. 5C. At this point the amount of pneumatic medium that is provided to the active pneumatic cushion 19 via the open check valve 18 is defined. Next, the piston 1 moves downwards, returning its mechanical energy and reducing the rate at which the pressure drops within the combustion chamber 41, and simultaneously pressing the pneumatic medium within the active pneumatic cushion 19, until it reaches its lowest position shown in FIG. 5D, slightly higher than the position shown in FIG. 5A. Due to a substantially constant volume of the combustion chamber between positions of FIGS. 5C and 5D, the gas in the combustion chamber 41 does not perform substantial work, and the energy is provided mainly by the passive cushion 20. The kinetic energy of the piston 1 is dissipated in the active pneumatic cushion 19. Due to the fact that the amount of pneumatic medium in the active cushion 19 is dependent on the maximum displacement of the piston, the energy losses are minimized. After position D the further phases of the cycle proceed as in a typical engine. Due to a higher compression ratio, the engine achieves greater efficiency than a standard engine, even taking into account the optimal, minimized energy losses in the active pneumatic cushion 19.

The compensating arrangement according to the invention can be used in heat engines with variable combustion chamber. It allows continuous change of compression ratio during the work cycle. The increase of pressure is related to a combination of the mass of the piston and parameters of the pneumatic cushions (springs) that support it. Therefore, the compensating arrangement can be used in engines having high range of rotational speeds (traction engines). Deceleration of the piston impacts its durability, therefore it must be performed on a given distance and with a relatively small counter pressure and have a character of quickly damped oscillations, which is guaranteed by the pneumatic active cushion. The elastic pneumatic sealings allow separating the hot part from the pneumatic part of the piston, therefore the losses of the pneumatic medium are limited. By using direct cooling, the piston can be used in highly heat-loaded and turbocharged engines. The scavenge (which is always present both at the hot side and the pneumatic side) to the cooling and lubricating system via the outlet conduit protects the piston from local overheating. By varying the diameter of the guiding sleeve, the pressure of the pneumatic medium is minimized. A simple construction of the piston makes it easy to manufacture and integrate with an engine. The shape of the piston increases its wear durability in case of homogeneous materials. Use of flap or channel check valves in the active cushion reduces its dead volume and increases the speed of filling, as well as provides appropriate durability. The arrangement is self-regulated even at small loads. The object of the invention can be used with homogeneous charge compression ignition (HCCI) engines at low coefficients of excessive air and allows reduction of exhaust fumes.

The invention claimed is:

1. A compensating arrangement for a variable compression ratio engine, the compensating arrangement comprising a piston (1) reciprocally movable in a guiding sleeve (2) having an open end (24) in communication with a combustion cylinder of the engine and a closed end (11), wherein the piston (1) has a shape of a hollow cylindrical tube having a first portion (25) with a closed end (31) movable in a first portion (28) of the guiding sleeve (2) and a second portion (26) having a diameter larger than the diameter of the first portion (25) and an open end (32) and movable in a second portion (29) of the guiding sleeve (2), and wherein the arrangement further comprises a first sealing (4) between the first portion (25) of the piston (1) and the first portion (28) of the guiding sleeve (2), a second sealing (8) between the second portion (26) of the piston (1) and the second portion (29) of the guiding sleeve, a first pneumatic cushion (20) formed between the closed end (11) of the guiding sleeve (2) and the internal surface of the piston (1) such as to limit the movement of the piston (1) towards the closed end (11) of the guiding sleeve (2), a second pneumatic cushion (19) formed between the guiding sleeve (2) and the external surface of the piston (1) limited by the first sealing (4) and the second sealing (8) such as to limit the movement of the piston (1) towards the open end (24) of the guiding sleeve (2), and a check valve (18) configured to provide pneumatic medium to the second pneumatic cushion (19) in amount dependent on the displacement of the piston (1) during its movement towards the closed end (11) of the guiding sleeve (2), characterized in that the closed end (11) of the guiding sleeve (2) is formed by a movable partition (11), wherein the position of the movable partition defines the maximum volume of the first pneumatic cushion (20)

and wherein the movable partition (11) comprises an inlet conduit (15) with a check valve (16) for providing pneumatic medium to the first pneumatic cushion (20).

2. The compensating arrangement according to claim 1, wherein the piston (1) further comprises an intermediate portion (27), having a conically expanding shape and located between the first portion (25) and the second portion (26) of the piston (1).

3. The compensating arrangement according to claim 2, wherein the guiding sleeve (2) further comprises a buffer (9) having a shape corresponding substantially to the internal profile of the intermediate portion (27) of the piston (1) configured to limit the movement of the piston (1) towards the closed end (11, 30) of the guiding sleeve (2).

4. The compensating arrangement according to claim 3, further comprising an outlet conduit (21) formed within the guiding sleeve (2) in communication with the second pneumatic cushion (19) to allow purge of pneumatic medium during movement of the piston (1) towards the open end (24) of the guiding sleeve (2).

5. The compensating arrangement according to claim 4, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

6. The compensating arrangement according to claim 3, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

7. The compensating arrangement according to claim 2, wherein the guiding sleeve (2) further comprises a buffer (10) having a shape corresponding substantially to the external profile of the intermediate portion (27) of the piston (1) configured to limit the movement of the piston (1) towards the open end (24) of the guiding sleeve (2).

8. The compensating arrangement according to claim 7, further comprising an outlet conduit (21) formed within the guiding sleeve (2) in communication with the second pneumatic cushion (19) to allow purge of pneumatic medium during movement of the piston (1) towards the open end (24) of the guiding sleeve (2).

9. The compensating arrangement according to claim 8, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

10. The compensating arrangement according to claim 7, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

11. The compensating arrangement according to claim 2, further comprising an outlet conduit (21) formed within the guiding sleeve (2) in communication with the second pneumatic cushion (19) to allow purge of pneumatic medium during movement of the piston (1) towards the open end (24) of the guiding sleeve (2).

12. The compensating arrangement according to claim 11, wherein the active cross-section of the outlet conduit (21) is adjustable by a needle valve (22).

13. The compensating arrangement according to claim 12, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

14. The compensating arrangement according to claim 11, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

15. The compensating arrangement according to claim 2, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

16. The compensating arrangement according to claim 1, further comprising an outlet conduit (21) formed within the guiding sleeve (2) in communication with the second pneumatic cushion (19) to allow purge of pneumatic medium during movement of the piston (1) towards the open end (24) of the guiding sleeve (2).

17. The compensating arrangement according to claim 16, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

18. The compensating arrangement according to claim 1, wherein the external wall of the first portion (25) of the piston (1) comprises a recess (3) and the first portion (28) of the guiding sleeve (2) comprises conduits (6, 7), the recess (3) and the conduits (6, 7) configured to be in fluid communication during movement of the piston (1), wherein the piston (1) comprises sealing (4, 5) surrounding the recess (3) between the external wall of the piston (1) and the guiding sleeve (2).

19. The compensating arrangement according to claim 1, wherein the check valve (16) is a flap valve.

20. The compensating arrangement according to claim 1, wherein the check valve (18) is a flap valve.

* * * * *